US006739343B1

(12) United States Patent
Trinkies et al.

(10) Patent No.: US 6,739,343 B1
(45) Date of Patent: May 25, 2004

(54) DO-IT-YOURSELF CIGARETTE MAKER AND COMPONENT ASSEMBLIES

(75) Inventors: Wolfgang Trinkies, Goldkronach (DE); Kurt Burghart, Wedel (DE)

(73) Assignee: British-American Tobacco (Germany) GmbH, Hamburg (DE)

( * ) Notice: Subject to any disclaimer, the term of this patent is extended or adjusted under 35 U.S.C. 154(b) by 0 days.

(21) Appl. No.: 09/646,811

(22) PCT Filed: Mar. 17, 1999

(86) PCT No.: PCT/EP99/01768

§ 371 (c)(1),
(2), (4) Date: Jan. 5, 2001

(87) PCT Pub. No.: WO99/48389

PCT Pub. Date: Sep. 30, 1999

(30) Foreign Application Priority Data

Mar. 23, 1998 (DE) ..... 198 12 644

(51) Int. Cl.[7] ..... A24C 5/00; A24C 5/02; A24C 5/06

(52) U.S. Cl. ..... 131/58; 131/66.1; 131/66.2; 131/70; 131/74; 131/75

(58) Field of Search ..... 131/66.1, 66.2, 131/70, 71, 74, 77, 75, 58, 108

(56) References Cited

U.S. PATENT DOCUMENTS

| | | | | | |
|---|---|---|---|---|---|
| 826,800 | A | * | 7/1906 | Prescott | 131/70 |
| 2,314,734 | A | * | 3/1943 | Ptasnik | 131/79 |
| 2,633,133 | A | * | 3/1953 | Higgins | 131/74 |
| 3,646,942 | A | * | 3/1972 | Asbill et al. | 131/65 |
| 3,786,818 | A | * | 1/1974 | Johnson | 131/304 |
| 3,822,710 | A | * | 7/1974 | Bramhill | 131/70 |
| 3,844,700 | A | * | 10/1974 | Sokolow | 425/526 |
| 4,164,229 | A | * | 8/1979 | Hurt | 131/55 |
| 4,572,216 | A | * | 2/1986 | Josuttis et al. | 131/70 |
| 5,009,237 | A | * | 4/1991 | Schmidt et al. | 131/70 |
| 5,072,740 | A | * | 12/1991 | Gatschmann et al. | 131/75 |
| 5,088,507 | A | * | 2/1992 | Baker et al. | 131/280 |
| 5,687,747 | A | * | 11/1997 | Schramm | 131/280 |
| 5,769,095 | A | * | 6/1998 | Schramm | 131/70 |

FOREIGN PATENT DOCUMENTS

| | | | | |
|---|---|---|---|---|
| DE | 425 478 | C | 2/1926 | |
| DE | 32 49 435 | A | 7/1984 | |
| DE | 3249435 | A1 * | 7/1984 | A24C/5/39 |
| DE | 3347966 | A1 * | 11/1985 | A24C/5/42 |
| DE | 33 47 967 | A | 11/1985 | |
| DE | 3347968 | A1 * | 11/1985 | A24C/5/42 |
| DE | 93 17 497 | U | 2/1994 | |
| EP | 0 144 060 | A | 6/1985 | |
| EP | 144060 | A2 * | 6/1985 | A24C/5/42 |
| FR | 2 716 344 | A | 8/1995 | |

* cited by examiner

*Primary Examiner*—Steven P. Griffin
*Assistant Examiner*—Carlos Lopez
(74) *Attorney, Agent, or Firm*—John F. Salazar; James E. Cole; Middleton and Reutlinger

(57) ABSTRACT

The invention relates to a do-it-yourself cigarette maker and its component assemblies, such as, a conveying device for cigarettes or tubes fitted with a lifting device, a device for shaping a tobacco rod fitted with a plucking roller, a tobacco rod conveyor fitted with a spring tappet, and a tube-aligning device with a narrowable slit for introducing the tube.

33 Claims, 8 Drawing Sheets

142
130
250
150
270
342

130
250
150
342

142
140
130
250
342

142
130
250
270
150
342

DO-IT-YOURSELF CIGARETTE MAKER AND COMPONENT ASSEMBLIES

BACKGROUND OF THE INVENTION

1. Technical Field

The invention relates to a do-it yourself cigarette maker and component assemblies, such as, e.g., a conveying device for cigarettes or tubes fitted with a lifting device, a device for shaping a tobacco rod fitted with a plucking roller, a tobacco rod conveyor fitted with a spring tappet, and a tube-aligning device with a narrowable slit for introducing the tube.

Do-it-yourself cigarette makers are known, for example, as small manual fillers, in which a plug of tobacco is inserted into an externally mounted tube by means of a pusher. Such small devices require a relatively high manual input, and thus a relatively long production time when several cigarettes need to be made. In addition, the quality of the cigarettes made greatly depends on the manual skill of the producer, with the result that rejects are produced quite often.

2. Description of Related Art

To get round these problems, automated cigarette fillers have been proposed, as are known for example from DE 33 43 500 C2, and which automate do-it-yourself production as far as possible. Such automated cigarette fillers are known from DE 33 47 966 C2, DE 33 47 967 C2, DE 33 47 968 C2 as well as from DE 32 47 370 A1 and EP 0 144 060 B1.

As regards metering the tobacco, the above-cited prior art in each case uses a funnel, below which a size-reduction or conveying means is arranged. These size-reduction or conveying means comprise, for example, singled or paired knife or pin shafts which, disadvantageously, heavily load and shred the long-fiber filling tobacco. Known from DE 425 478 is a cigarette filler comprising several spike-toothed rollers, the first of which is arranged directly below a totally enclosed funnel mount.

As regards tube feeding, the cited prior art regularly proposes either allowing the tubes to drop from an inclined plane into a receptacle, from which they are then transported axially to a receiving cone, or to use a picker to take the tubes out of a tube hopper, which is swiveled to thereby pass on the empty tube. Since empty tubes are easily deformed and cannot always be arranged singly in parallel in a tube hopper arranged inclined, disadvantageously, in both of the tube conveyors cited in prior art, it cannot always be assured that only a non-deformed tube is passed on. Singling the tubes in the non-deformed condition, and thus a frictionless operation, can thus not be assured since even the slightest disorientation or jamming resulting from tube deformation will result in the empty tube section being trapped, and forced downtime occurring. In addition, the tubes must always be conveyed axially in order to be placed with their open face ends on a conical means. This may result in damage to the tube. DE 241 698 proposes to swivel the hopper bottom, hinged on one side upwards, in order to lift a cigarette tube from a tube hopper; this requiring particularly complicated means to be arranged for singling the tubes.

In order to insert a pre-shaped tobacco rod into an empty tube, tappets in accordance with the prior art are used which, as proposed, for example, in EP 0 144 060, comprise at their front end an insertion aid (shingled scoop). Disadvantageously, the scoop in accordance with the cited European patent is arranged rigidly at the front end of the tappet, with the result that it obstructs the expansion of the tobacco as long as it is located in the tube together with the tobacco rod When operating entirely without any insertion aid, it is difficult to insert a tobacco rod with axial homogenous packing density into the tube, since a relatively random compression materializes lengthwise during this operation. Known from German laid-open patent publication 22 09 862 is a manual cigarette filler comprising a pusher and a plunger, which pushes a plug of tobacco and a filter in a predetermined sequence. German patent 93 17 497 U1 describes a do-it-yourself cigarette maker, comprising a bore with a co-axially arranged guide rod for receiving a cigarette tube.

SUMMARY OF THE INVENTION

It is an object of the present invention to improve a do-it-yourself cigarette maker or the component assemblies thereof so that the above-cited disadvantages of the prior art are obviated as far as possible.

In this connection, at least part of the object of the present invention is to provide a tube or cigarette conveyor for such a do-it-yourself cigarette maker, which reliably singles the tubes and supplies them, as non-deformed as possible, to the filling procedure.

Another object of the present invention is to provide a tobacco rod shaping device which permits gentle treatment of the long-fiber filling tobacco.

It is furthermore an object of the present invention to provide a tobacco rod conveyor for a do-it-yourself cigarette maker which does not obstruct expansion of the tobacco in the cigarette tube after insertion and ensures that cigarettes materialize with a homogenous package density.

The invention is furthermore intended to provide a tube-aligning device or straightener with which deformed cigarette tubes can be simply and reliably restored into a condition suitable for further processing.

Finally, the present invention is further intended to provide a do-it-yourself cigarette maker which overcomes the cited disadvantages of the prior art.

The cited objects of the present invention are achieved by the subject matters of the independent claims, the sub-claims describe advantageous embodiments of the invention.

A tube or cigarette conveyor for a do-it-yourself cigarette maker in accordance with the invention comprises the following elements:

- a tube hopper for receiving a supply of empty cigarette tubes,
- a discharge device for a tube to be filled with a tobacco material,
- a holder mechanism for holding the tube during the filling operation, and
- a cigarette hopper for receiving the filled cigarettes.

In this arrangement, the discharge device in accordance with the present invention is a lifting device which raises a tube from below out of the tube hopper, the lifting device comprising a pusher, the top edge of which has a longitudinal recess [a lower forming member or lower format].

The advantage of this tube or cigarette conveyor is, more particularly, that by lifting the tube from a hopper in which the tubes are normally located loosely stacked, no strain materializes which could result in deformations obstructing production. The other tubes, located above the tube being lifted out from the tube hopper, simply slide down from the tube to be lifted out and are unable to create any permanent deformations due to their own light weight.

The pusher in the tube hopper is preferably arranged so that the longitudinal recess in the lowered condition forms part of the bottom at the lowest point of the tube hopper. In this point of the tube hopper, usually only one cigarette tube is located for "dropping into" the longitudinal recess in the lowered condition. The longitudinal recess surrounds the tube from underneath without exerting any deforming forces. This ensures that, when the pusher is raised, the tube comes upwards without being damaged, and more particularly that only one tube is arranged in the longitudinal recess. In particular, when relatively few tubes are located in the tube hopper, this arrangement ensures that, subsequent to raising of the tube, this as the sole non-distorted tube, is transported to and held positively at the position where it is to be filled with tobacco.

Preferably, the pusher can be arranged at a straight wall of the tube hopper, along which it is raised, deflectors being arranged at the upper part of the wall which are capable of returning all raised tubes back into the tube hopper with the exception of the one located in the recess of the pusher.

The advantage of this embodiment is particularly evident when a large number of tubes are present in the tube hopper. When the pusher is raised, the straight wall of the tube hopper forms a stable support for the tube located on the longitudinal recess. Any other tubes which may be located thereon are deflected when the upper edge of the pusher is run into the upper portion of the wall. This ensures that even when the tube hopper is full, tube singling is still easily possible.

The deflectors may comprise at least one, but preferably two, pivot clips oriented transversely to the longitudinal recess of the pusher and, when the pusher is raised, initially come to rest on the raised tube, while, upon further raising, they slide past the tube into slots in the pusher so that they are located underneath the tube and transport the filled cigarette into the cigarette hopper upon lowering of the pusher. In such a way, the deflectors can be simultaneously used as a mechanism for further conveying the filled cigarette by lifting it from the longitudinal recess when the pusher is lowered so that the cigarette automatically drops into the cigarette hopper.

In an embodiment described above, the clips are preferably arranged on a common pivoting axis and are pretensioned in the direction of rotation by means of a lever weight so that, upon raising of the tube, their middle sections initially lightly press on the tube, while their front sections deflect further tubes. Advantageously, one of the clips comes to lie on the filter of a filter tube, where the force produced by the lever weight permits no deformation of the cigarette. Due to the connection of both clips on a single pivoting axis, the other clip will also not deform the empty cigarette paper of the tube in this condition.

In an embodiment of the tube or cigarette conveyor in accordance with the invention, the means for holding the tube during the filling procedure comprises a recessed surrounding section or upper forming member, also termed upper format, which at least partly surrounds the tube or cigarette from above. The longitudinal recess of the pusher [lower forming member], in the raised condition, together with the recessed upper forming member of the holder means may substantially completely surround the tube during the filling procedure.

In accordance with the invention, after raising of the pusher, the cigarette tube is held in place by an external surrounding member during the filling procedure, i.e., it is no longer necessary to raise the tube axially to a conical nozzle by means of a shifting mechanism, as is done in the prior art. Advantageously, this removes the axial movement requirement and, in addition, the risk of the tube being deformed by such a movement can be eliminated. Due to the surrounding hold in the holder mechanism, already deformed tubes may be gently restored to their circular shape.

In another preferred embodiment, the holder mechanism comprises sensors, more particularly a photocell, which detects the presence of a tube or cigarette or the empty condition of the holder mechanism. This thus provides a control mechanism which ensures that no further tube is introduced into the holder until the produced cigarette has been ejected.

In a further embodiment of the tube or cigarette conveyor in accordance with the invention, the tube hopper and/or the cigarette hopper are configured as drawers, in particular the bottom of which is configured latticed. Since the dropping of tobacco remnants into the tube hopper or cigarette hopper cannot always be avoided, these are best maintained free of such tobacco remnants by arranging for the remnants to simply drop through the bottom. This is possible when the bottom is configured latticed, for example as a wire lattice. When a removable catchment vessel is provided below the tube hopper and/or cigarette hopper, the tobacco falling through can be easily eliminated.

Configuring the tube or cigarette hopper as a drawer facilitates inserting the tubes and removing the cigarettes.

A tobacco rod shaping mechanism in accordance with the invention, which can be provided in particular for a do-it-yourself cigarette maker, comprises the following components:

a funnel-shaped tobacco material infeed section a singling device for the tobacco material, and a tobacco rod compression mechanism.

The singling device, in this arrangement, is a roller, partly surrounded by a housing, with a plucking mechanism arranged at the circumference of the roller. In particular, a plucking roller with plucking pins, is used to convey the tobacco material into the tobacco rod compression mechanism. Formed between the housing and the roller is a gap through which the tobacco, plucked from the funnel-shaped section, is introduced into the compression mechanism. Advantageously, this plucking action ensures gentle treatment of the tobacco, i.e. the long-fiber filling tobacco is not excessively pulled to pieces and reduced in size as in prior art (knife rollers). This has a positive effect on the filling capacity of the tobacco.

In accordance with the invention, the funnel-shaped infeed section comprises at least one wall section oriented radially to the roller axis, more particularly one wall section being pivot-mounted so that it can be pivoted out of the way of the roller from a secured working position. At the wall section radially joined to the roller, the tobacco can be well plucked out in the funnel-shaped infeed section. When a wall section can be pivoted out of the way, excess tobacco materializing, for example after a number of cigarettes have been produced, can be removed directly from underneath the roller, it preferably being allowed to drop into a removable catchment means.

In accordance with an advantageous embodiment, the tobacco rod compression mechanism comprises a tobacco chamber, which can be opened up and closed from at least one side, the travelling side part of the chamber preferably being shifted by means of a cam from the opened into the closed position against a spring preload, and the opening width of the chamber is preferably settable by means of a positioner.

The wall sections, surrounding the tobacco rod to be shaped, are advantageously provided in accordance with the invention with an anti-stick coating facilitating the ejection of the tobacco from the tobacco chamber.

The roller may be inserted removable, it preferably furthermore being made of a material resistant to corrosion, for example aluminum, with an $AlO_2$ surface finish.

The tobacco rod conveyor for a do-it-yourself cigarette maker in accordance with the invention comprises a tappet, which can be drawn in and out of a chamber containing a tobacco rod. The tappet has an outer tube in which, in turn, a guide rod may run, the guide rod comprising at its front end an insertion aid for the tobacco material. This configuration has the advantage that the insertion aid at the guide rod can be retracted into the tubular tappet while the tobacco is already in the cigarette tube, the outer tube, at the same time, still being in contact with the tip of the cigarette. In this condition, the tobacco, which is compressed in the tobacco compression chamber to a diameter somewhat smaller than the inner diameter of the cigarette tube, is able to implement an expansion action, which is not obstructed by the insertion aid. The open tip of the cigarette is closed off by the face end of the outer tube to achieve a homogenous distribution of the tobacco in the cigarette which is then compacted on all sides substantially to the same degree. As the insertion aid is retracted from the outer tube in contact with the tube at the tobacco end, remnants of tobacco are also prevented from being removed from the cigarette upon extension of the insertion aid.

In an embodiment of one such tobacco rod conveyor, the guide rod may comprise an appendage at its rear end by which it can be withdrawn from the outer tube in overcoming the pressure of a spring provided at the outer tube, the insertion aid for the tobacco material thereby entering the outer tube. When, in such a configuration, the guide rod is retracted after the cigarette tube has been filled, the outer tube, when suitably blocked, initially remains in contact with the front end of the cigarette. To then also remove the outer tube from the cigarette, all that needs to be done is to release the blocking action so that the outer tube snaps back, i.e. there is no need to move the cigarette tube or the filled cigarette during the filling procedure and until after its completion.

An insertion aid used in accordance with the invention has substantially the length of the tobacco rod and is shaped so as to assist pushing of the tobacco rod only in the conveying direction. It may be configured, for example, as a blade, toothed in one direction, or as a shingled scoop.

As regards blocking the outer tube to advantage in the position at the open end of the cigarette, which has been already mentioned, one advantageous configuration consists of the tappet being shifted back and forth at its rear end by means of an eccentric drive, preferably, a support engaging with the eccentric drive, in particular a retaining lever, holding the outer tube in position upon removal of the guide rod after conveyance of the tobacco rod.

The tube-aligning device or straightener in accordance with the invention, which in particular may be provided in a do-it-yourself cigarette maker, comprises a receiving element for the tube, which consists of a circular gap between a housing and a mandrel secured in the housing. The circular gap comprises substantially the axial length of a cigarette tube and at the insertion end a device is provided with which the circular gap can be constricted. By constricting the circular gap subsequent to insertion of a deformed cigarette tube, a smoothing effect is achieved when this tube is pulled out again, meaning that cigarette tubes, thus treated, are directly suitable for reuse in cigarette making. Advantageously, straightening the tubes in this way can be implemented by very few handholds.

In a preferred embodiment of the tube-aligning device, the constricting device comprises a clamping screw, for screwing to the insertion end, as well as collets, arranged between mandrel and housing, the gap between the collets and the mandrel being constricted by turning the clamping screw.

In the region of the collets, an O-ring may be provided around the mandrel, at which preferably also an adapter ring is located for fixing. In an arrangement such as this, infeeding the tubes into the tube-aligning device is facilitated by centering the O-ring by means of the adapter ring.

Furthermore, a do-it-yourself cigarette maker in accordance with the invention comprises one or more of the component assemblies described above, namely a tube or cigarette conveyor, a tobacco rod forming means, a tobacco rod conveyor and a tube-aligning device, thus achieving the above-described advantages linked with each of these component assemblies.

Furthermore, the do-it-yourself cigarette maker may comprise motors, in particular electric motors for the components to be driven, as well as a preferably electronic sequence control which, with the aid of sensors, monitors and regulates the operating condition in each case and in particular provides an external indication thereof by display means.

The tappet of the tobacco conveyor, the tobacco compression chamber, the tobacco rod shaping means and the tube holding means, for holding the tube during the filling procedure, are all arranged in line in a do-it-yourself cigarette maker in accordance with the invention, these components being configured so that, upon removal of the tappet, a through hole exists in this line. Such a through hole facilitates cleaning the apparatus in the region of the tobacco chamber, for this purpose, an elongated brush or a device similar to a pipe cleaner can be pushed through.

BRIEF DESCRIPTION OF THE DRAWINGS

The invention will now be explained in detail by way of a preferred embodiment of a do-it-yourself cigarette maker with reference to the drawings in which.

DETAILED DESCRIPTION OF THE PREFERRED EMBODIMENTS

Figure 1:
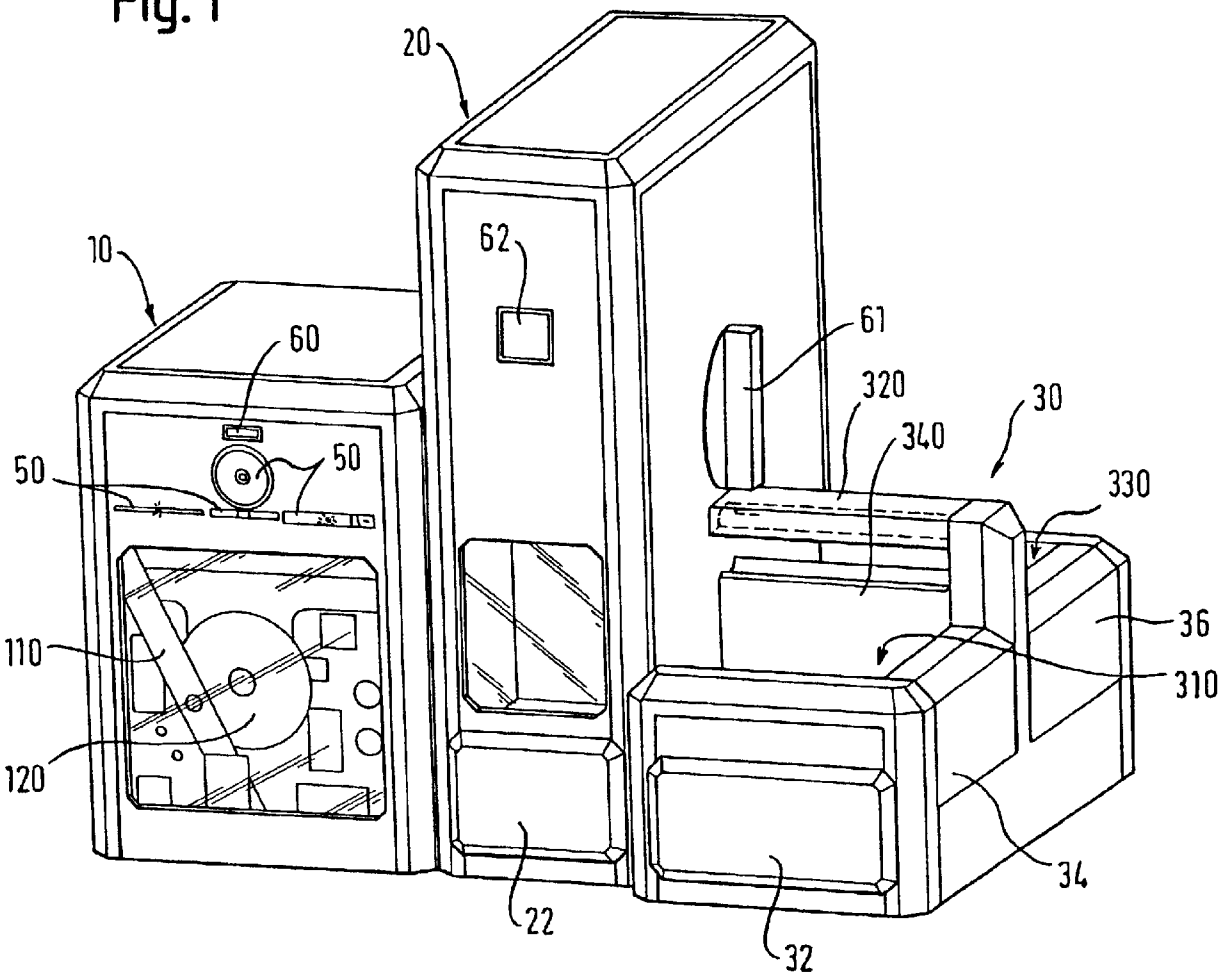
FIG. 1 is an outer view in perspective of a do-it-yourself cigarette maker in accordance with the invention.

In the perspective outer view of FIG. 1, the do-it-yourself cigarette maker in accordance with the invention can be seen as a whole, including the housing or casing sections 10, 20 and 30.

Accommodated in the housing section 10 is the tobacco rod conveyor, two components of which, namely the wheel 120 and the lever 110 of the eccentric drive, being visible through a window. Furthermore, provided at the housing is a pushbutton 60 for starting the apparatus as well as display means 50 indicating the corresponding operating condition, namely plucking of the tobacco, compression of the tobacco rod and insertion of the tobacco rod into the tube.

Provided in the middle is the housing 20, accommodating the tobacco rod shaping device which will be described in detail later on. Provided below the window, also arranged in the housing 20, is a removable catchment receptacle for tobacco remnants, which can be slid out frontwards at its panel 22. With the aid of the lever 62, the front wall section 214 can be hinged forward out of the way and the plucking roller 220, to be described later, rotates to empty the tobacco hopper 210. Using the bayonet lock 61, which will also be described later, the plucking roller can be removed. Located on the right side of the housing 20 is the tube or cigarette conveying section 30, which comprises a tube hopper 310, a pusher 340, an upper format 320 and a cigarette hopper 330.

Like the housing 20, the tube or cigarette conveyor comprises a bottom catchment receptacle for tobacco material which can be pulled out to the front with the aid of the panel 22. The tube hopper 310 is configured as a drawer and can be removed from the side wall 34. Likewise, the cigarette hopper 330 is also configured as a drawer, which, again, can be removed from the side wall 36.

Figure 2:
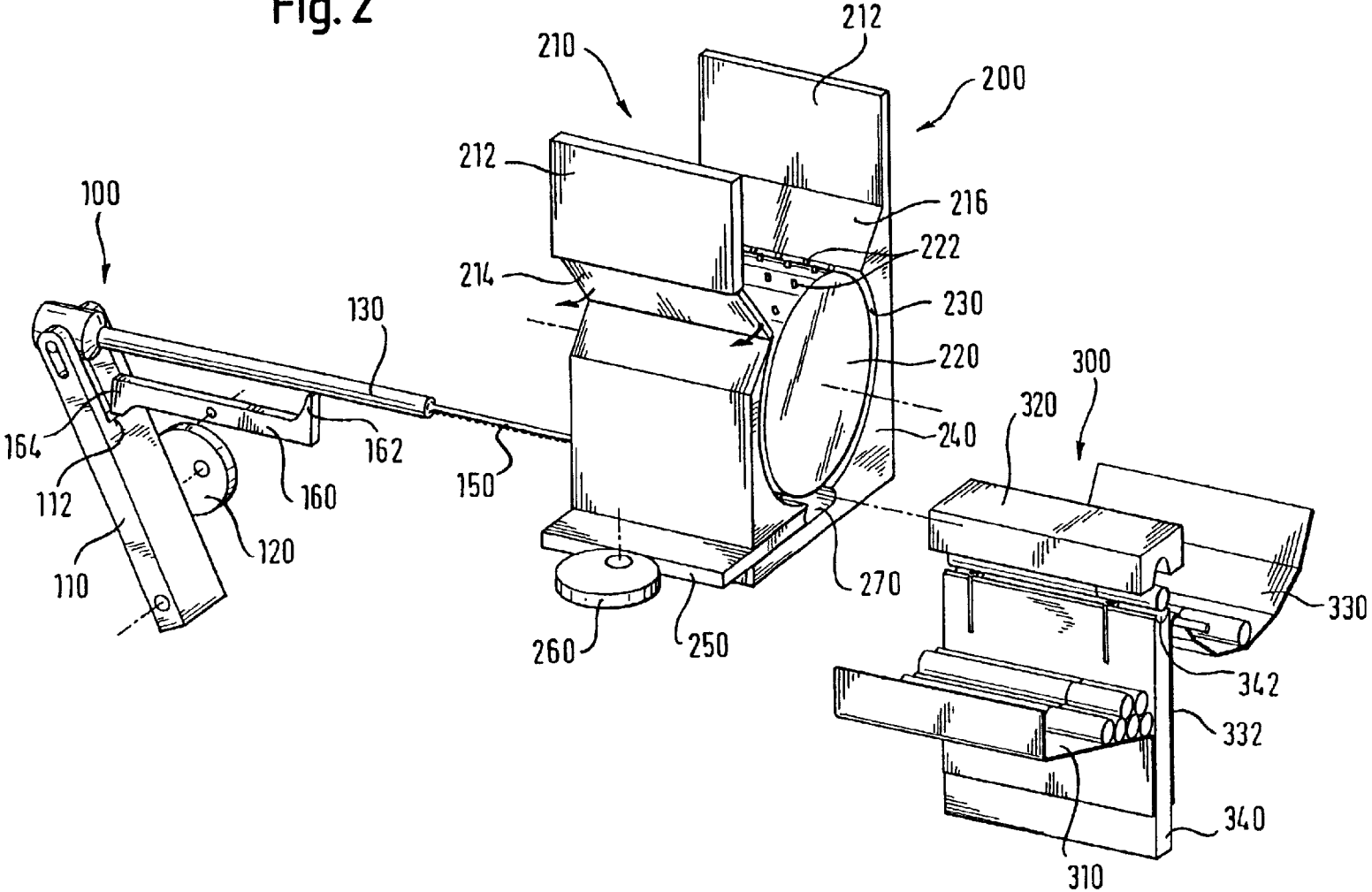
FIG. 2 is an exploded view in perspective of the three main component assemblies of the do-it-yourself cigarette maker, namely a tube or cigarette conveyor, a tobacco rod shaping device and a tobacco rod conveyor.

Illustrated in FIG. 2 in an exploded view in perspective are the individual functional component assemblies of the do-it-yourself cigarette maker in accordance with the embodiment shown. Represented on the left side is the tobacco rod conveyor 100, which is configured as an axially shifting tappet. Evident from the tappet in FIG. 2 is the outer tube 130 as well as the toothed blade 150 serving as an insertion aid for the tobacco rod. The tappet is moved back and forth in axial direction by means of an eccentric drive comprising the eccentric cam 120 and the lever 110. Also provided is a retaining lever 160 with a front latching protuberance 162 and a rear lever projection 164 capable of riding on edge 112.

Figure 3:
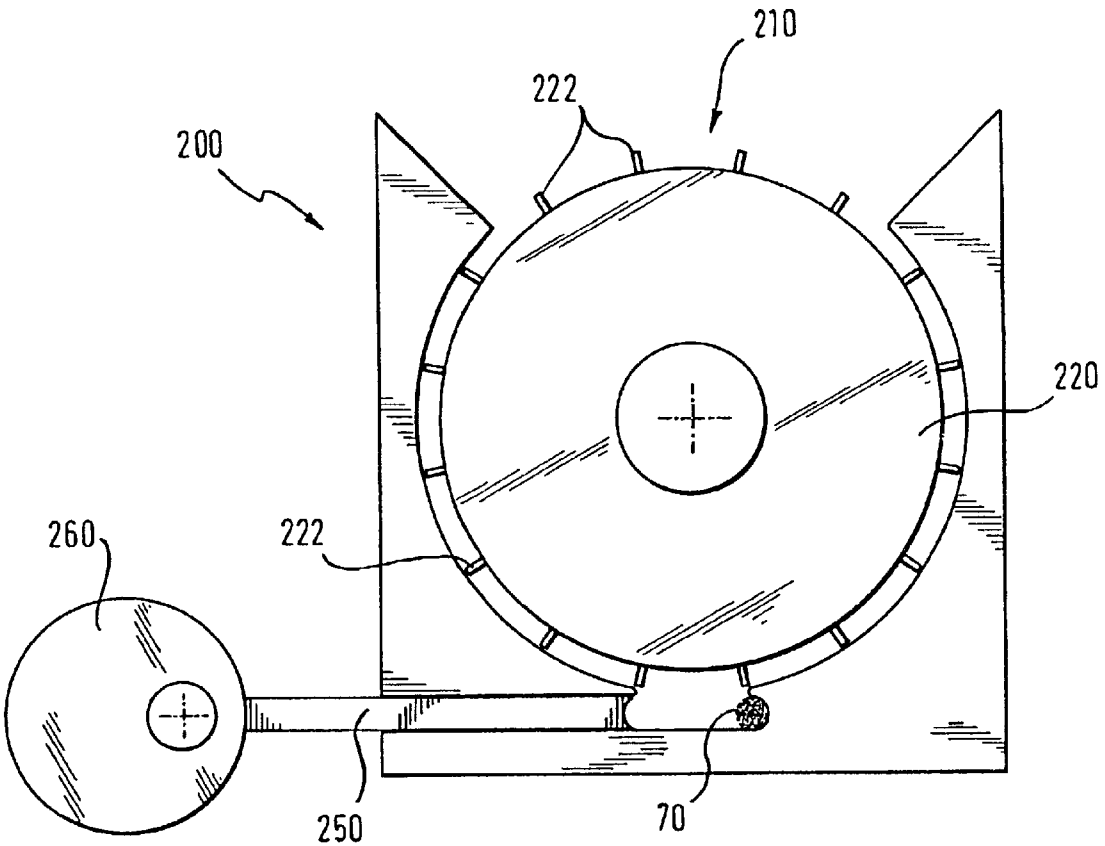
FIG. 3 is a schematic cross-section through a tobacco rod shaping device.

Shown in the center of FIG. 2 is the tobacco rod shaping means 200 consisting of a tobacco filling funnel 210, including the opposing upper funnel wall parts 212 and the radially arranged lower front wall parts 214 and 216. The front wall part 214 is shown separately and may be tilted away in the direction of the arrows in order to clean tobacco downwards out of the funnel 210. Arranged below the funnel 210 is the housing 240 in which a plucking roller 220, comprising plucking pins 222, is rotatively mounted. Located between the circumference wall of the roller 220 and the housing 240 is a gap 230, through which the tobacco, plucked from the funnel 210, is conveyed downwards. Below the roller is a tobacco chamber 270, into which the tobacco drops, as described above. The side wall of the tobacco chamber, shown at the front in FIG. 2, is formed by a compressive pusher 250 which can be traveled in the lower housing part towards and away from the longitudinal centerline of the tobacco chamber 270, i.e. by means of a cam 260. When the compressive pusher 250 is traveled fully up to the longitudinal centerline of the tobacco chamber 270, a tobacco rod is compressed from the tobacco introduced into the tobacco chamber 270 by the plucking roller 220. In FIG. 3, such a compressed tobacco rod 70 is illustrated in the cross-sectional illustration of the tobacco rod shaping device, after it has been shaped by means of the compressive pusher 250.

It is to be noted that FIG. 3 merely serves to show the shape and location of the compressed tobacco rod 70. The cam 260 is merely illustrated schematically and turned 90° for a better representation, whereas, in a real sequence of the filling procedure, the pusher 250 would remain in position at the tobacco rod 70 until it is pushed out.

Finally, illustrated in FIG. 2 on the right is the tube or cigarette conveyor 300, still in the uncased condition. Its main components are the tube hopper 310, the tube pusher 340, including the lower forming member or lower format 342, configured as a longitudinal recess on the upper side of the pusher 340, the upper forming member or upper format 320 as well as the cigarette hopper 330.

The electric motors, needed to power the respective components and the operating control, are not shown. They may be achieved, however, by measures known from prior art. For example, the upper format 320 comprises a photocell at its rear end, which detects whether a cigarette tube or a filled cigarette exists in the upper format or forming member, the electronic control then ensuring that a new filling sequence only starts when the upper format 320 is empty again.

Before going into further details, the general sequence of events involved in making the cigarettes using the do-it-yourself cigarette maker will now be described.

Firstly, long-fiber filling tobacco is introduced into the funnel 210 and empty filter tubes, as shown in FIG. 2, are inserted into the tube hopper 310 with the open end pointing in the direction of the tobacco rod shaping mechanism 200. After the apparatus has been started, for example by means of the pushbutton 60 (see FIG. 1), an empty cigarette tube is raised from the tube hopper 310 by means of the pusher 340 so that it is held captive between the lower format 342 and the upper format 320 to "shape up" the tube, i.e. to eliminate possible deformations so that the tube has substantially a completely round cross-section.

Once the tube has been firmly positioned at the upper format, the plucking roller 220 is rotated, i.e. by roughly one rotation in the conveying direction and then returned by a quarter rotation to remove any pile-up of the tobacco at the gap opening of the lower funnel wall 216. This results in tobacco being plucked from the funnel 210 and introduced into the tobacco chamber 270, the tobacco thereby being treated gently, so that it remains long-fibered. This conveying procedure is implemented as often as is needed to sufficiently fill the tobacco chamber 270, it automatically being ensured that substantially the same amount of tobacco is present everywhere in the longitudinal direction of the tobacco chamber 270 since any excess tobacco at the initially or first filled portion of the chamber 270 may be conveyed upwards again via the plucking roller. Alternatively, locations initially having less tobacco are refilled with tobacco in the course of the rotations of the roller 220. The number of rotations needed can be preset.

Once sufficient tobacco is present in the tobacco chamber 270, the compressive pusher 250 is pressed together via the cam 260 in the direction of the longitudinal centerline to thus produce a compressed plug of tobacco, the diameter of which is somewhat smaller than the inner diameter of the tube.

In the aforementioned compression procedure and when introducing the tobacco into the tobacco chamber 270, the toothed blade 150 is located in the tobacco chamber. After the latter has been run together, the compressive pusher 250 remains in its advanced condition for a certain length of time.

After the aforementioned residence period has elapsed, the tobacco is inserted axially forwards into the cigarette tube with the aid of the tobacco rod conveyor 100 this procedure being described in more detail later on.

Once the tobacco plug has been inserted into the tube, the toothed blade 150 still remains for a certain length of time in the cigarette so that the tobacco can expand and a sufficient friction develops at the inner surface of the tube before the tobacco conveyor is retracted.

After the above procedure has been effectuated, the pusher 340 is returned downwards and the finished cigarette is conveyed into the cigarette hopper 330 by means of deflector, which will likewise be described later. This concludes production of the cigarette and production of the next cigarette can commence. Each of the procedures cited above takes place sequentially, one after the other. Either the tube or cigarette conveyor, the tobacco rod conveyor or the tobacco rod shaping mechanism is in operation, the sequence of events not overlaping.

Concerning the tobacco rod conveyor, reference is now made to FIGS. 4A to 4D and FIG. 5, to explain the details. The tobacco rod conveyor 100 is shown in detail in FIG. 5. It consists of an outer tube 130 and a guide rod 140 axially shiftable in this outer tube 130. Fitted to the front face of the guide rod 140 is the toothed blade 150, the teeth of which are inclined forward to permit advancing the tobacco rod forward while permitting a relatively simple slide out from an inserted plug of tobacco.

Figure 5:
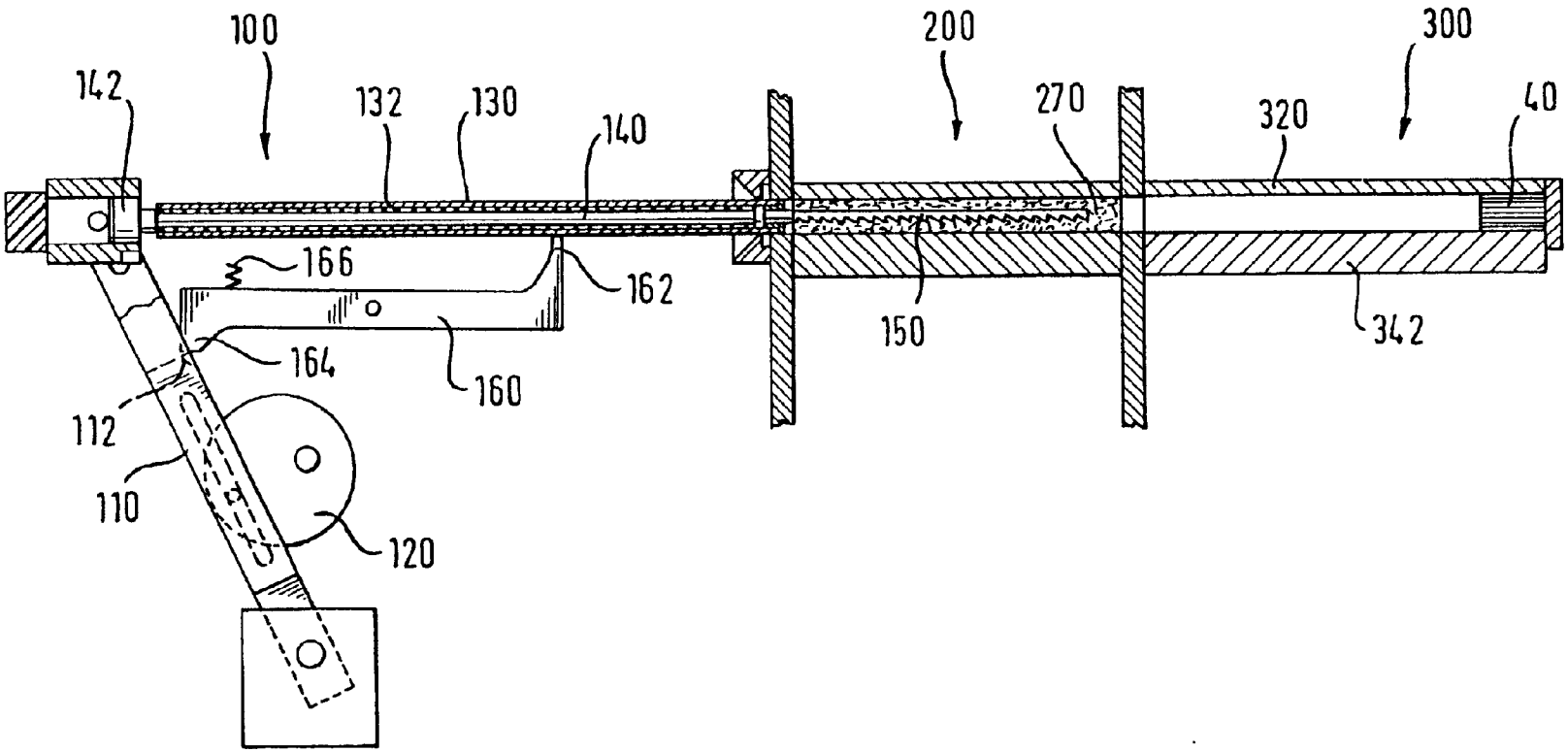
FIG. 5 is a longitudinal section through a tobacco rod conveyor in accordance with the invention, showing the components adjoining in the conveyor line of the tobacco rod.

The guide rod 140 is pre-tensioned by means of a spring 132 in the outer tube 130 so that the guide rod and outer tube are loosely nested. The guide rod 140 can be withdrawn from the rear of the outer tube 130, i.e. to the left as shown in FIG. 5, in overcoming the spring force. Likewise evident from FIG. 5 is the tobacco chamber 270 in which the toothed blade 150 is located as well as the upper format 320 and lower format 342, a tube 40 being formed therebetween.

The back and forth movement of the tobacco rod conveyor 100 is provided by an eccentric drive with an eccentric cam 120 and a lever 110 fixedly mounted at its lower end and clasping at its upper end a rear appendage 142 of the guide rod 140 by means of a mounting fixture. Upon rotation of the eccentric cam 120, the tobacco rod conveyor (tappet) 100 is driven back and forth via link guides.

Also evident from FIG. 5 is the retaining lever 160, which ensures by means of a latching protuberance 162 that after the tobacco plug has been introduced into the tube in the format 320, 342, the outer tube 130 initially remains in its position during the return movement of the guide rod 140. For this purpose, the latching appendage 142 hooks into the left end of the outer tube 130 so that, upon return of the guide rod at the appendage 142, the toothed blade 150 first travels into the outer tube until the lever 110 rides by an inner edge 112, over the lever projection 164. This releases the latch of the retaining lever 160 with the outer tube 130. Due to the spring force, the outer tube is then able to snap back into the position shown in FIG. 5. The indicated spring 166 ensures that the latched condition of the retaining lever 160 is maintained until it is released by the lever projection 164 riding along the edge 112.

How the above described sequence occurs in detail is again illustrated in FIGS. 4A to 4D. It is to be noted that the FIGS. 4A to 4D are merely schematic illustrations, i.e. the shapes of the components do not exactly match the real shapes. Thus, the cavity 270 can be compared to the closed tobacco chamber, if one imagines that the part 250 is shiftingly mounted. The recess 342 can be compared to the lower format of the pusher 340.

Figures 4A, 4B, 4C, 4D:
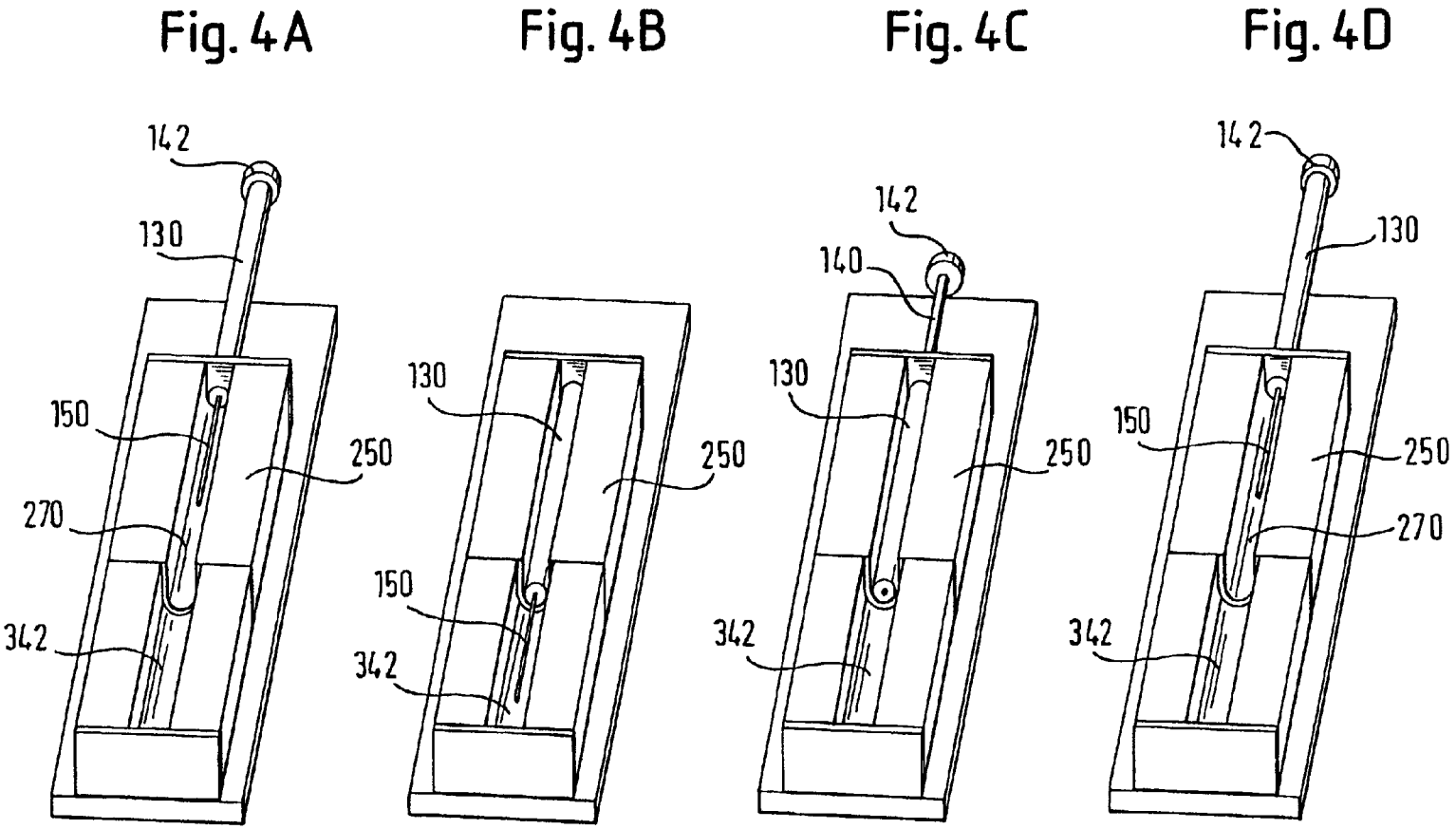
FIGS. 4A to 4D: are schematic illustrations of the sequence in action of a do-it yourself cigarette maker in accordance with the invention.

In FIG. 4A there is illustrated the condition in which tobacco has been pressed into the tobacco chamber 270, the toothed blade 150 already being located in the tobacco chamber 270, as also illustrated in FIG. 5. Of the tappet 100, the outer tube 130 and the rear appendage 142 of the guide rod 140 (not shown) are evident.

The tobacco plug is then urged into the tube and the condition subsequent to this action is shown in FIG. 4B. For this purpose, the outer tube 130 is advanced together with the toothed blade 150 until the front face end of the outer tube 130 locates at the transition between tobacco chamber and tube format. The tappet then remains in this position for some time so that the tobacco is able to expand in the tube and exert sufficient friction on the inner part of the tube.

At the end of this time period, the guide rod 140 is then withdrawn from the outer tube 130 to the rear until the toothed blade 150 totally disappears in the outer tube 130. Since the front face of the outer tube is still urged against the tip of the cigarette, no tobacco is able to drop out of the cigarette. On retraction of the guide rod 140, the outer tube 130 latches in position by means of the retaining lever 160, as shown already in FIG. 5.

After this, the outer tube 130 reverts back, as urged by the spring 132, to the appendage 142, resulting in the condition shown in FIG. 4D, in which the tobacco chamber 270 can be refilled.

Figure 6C:
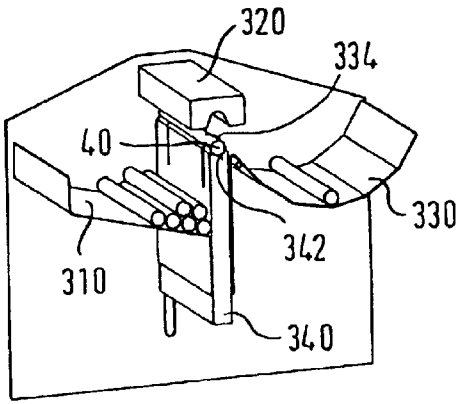
FIGS. 6A to 6E: illustrate the operating conditions of the tube or cigarette conveyor during production of a cigarette.
Figure 6B:
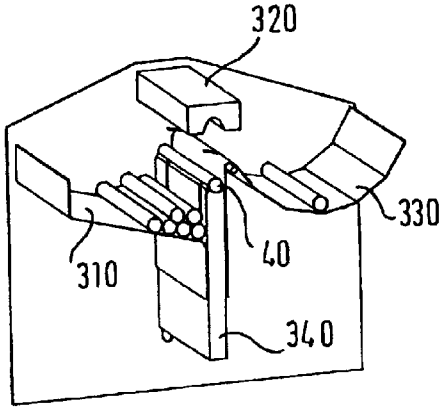
Figure 6A:
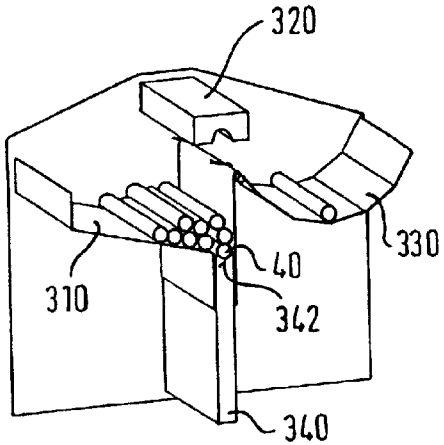
Figure 6E:
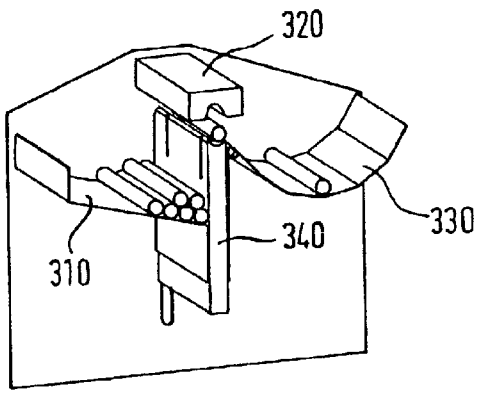
Figure 6D:
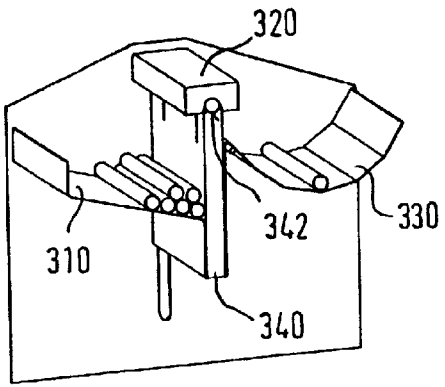

FIGS. 6A to 6E illustrate the operating sequence in detail of the tube or cigarette conveyor 30. Shown in FIG. 6A is the condition before a tube 40 is fed to the filling procedure. At its upper side, the pusher 340 comprises a longitudinal recess serving as the lower format 342. When the pusher 340 is fully retracted, it is located at the lowest point of the tube hopper 310 and receives an empty tube in the lower format 342. FIG. 6B then shows the condition in which this tube 40 is raised, i.e. beyond the condition as shown in FIG. 6C into the condition as shown in FIG. 6D, where the lower format 342 and upper format 320 hold the cigarette tube in position so that the tobacco plug can be introduced therein.

To be seen from FIG. 6C is part of a clip 334 of a deflector in contact with the tube 40, the functional and configuration of which will be explained in more detail later.

After the cigarette has been filled with the tobacco plug, the pusher 340 is returned downwards and the cigarette is conveyed in the condition shown in FIG. 6E into the cigarette hopper 330.

Figure 7:
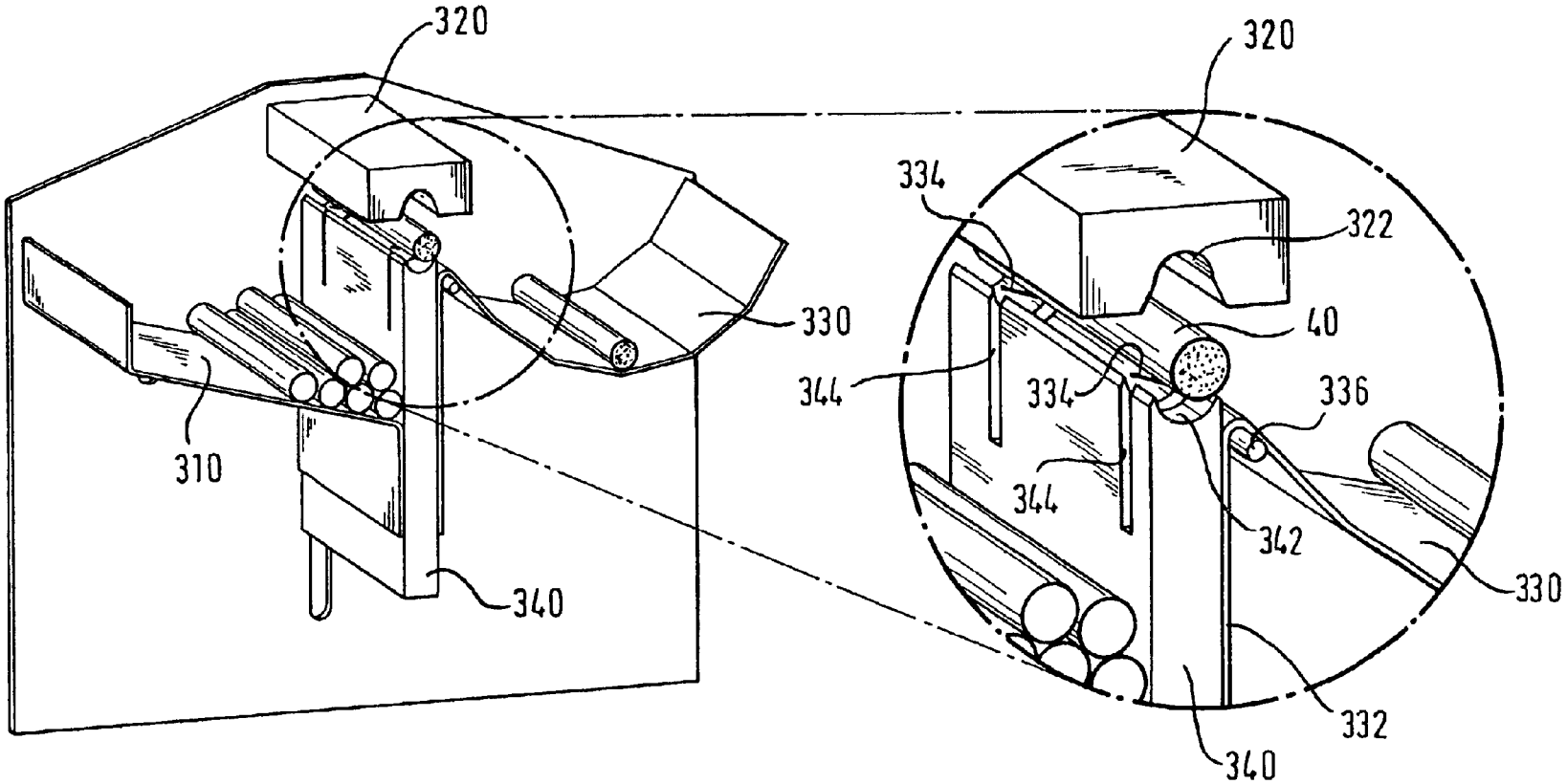
FIG. 7 is a magnified representation of a detail taken from FIG. 6E to make the individual components evident.

The condition shown in FIG. 6E is also shown in FIG. 7, but magnified, the deflector now being clearly evident from the magnified detail as shown on the right. It consists of the clip 334 which is fitted to the upper edge of the wall 332, seated on the common longitudinal centerline 336 and pre-tensioned by means of a lever weight in the direction of rotation. The clips may be lowered into the slots 344 in the pusher 340. They are rotatively mounted and can thus, on upwards travel of the tube 40 in initially being located above this tube 40, ride past it and into the slots 344. They are then in the condition shown in FIG. 7, namely on return downwards travel of the pusher 340 below the tube 40 so that the tube is able to drop by the slanting upper side into the cigarette hopper 330.

Upon upwards travel of the tube (see FIG. 6B), the front ends of the deflectors 334 also serve as deflectors for possible further cigarette tubes included in the raising to thus ensure that only one, single tube is raised to the upper format 320. In this arrangement, a clip, in its middle portion, lies preferably on the filter of the tube to avoid any deformations.

Figure 8:
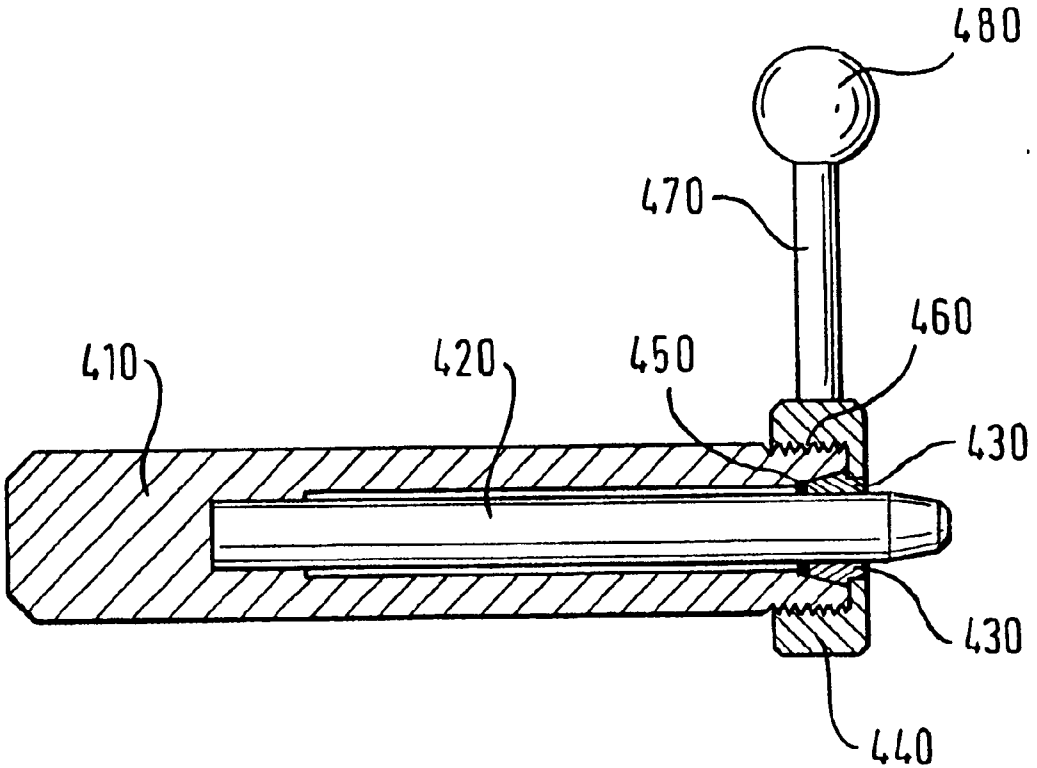
FIG. 8 is an illustration of a tube-aligning device in accordance with the invention.

Represented in FIG. 8 is now a further component assembly, namely a tube-aligning device which may be included in the do-it-yourself cigarette maker to straighten very deformed tubes. The tube-aligning device consists of a receiving sleeve 410, a receiving mandrel 420, collets 430, a male thread 460, applied to the front end of the receiving sleeve 410, and a clamping screw 440 which can be screwed in place by means of a clamping lever 470 and a ball 480. Provided at the inner end of the collets is an O-ring.

An adapter ring may be provided surrounding the O-ring 450 to center the O-ring 450 and thus to facilitate insertion of the tubes.

A tube is inserted in the open condition of the clamping screw 440, and thus of the collets 430, from the right via the mandrel into the circular gap between receiving sleeve 410 and receiving mandrel 420. Afterwards, the clamping screw is slightly tightened on the thread 460 by means of the clamping lever 470 so that the gap between the collets 430 and the mandrel 420 is narrowed.

Already by pushing the tube onto the receiving mandrel, the round shape of the cigarette tube is substantially obtained again. When the collets are then constricted, the tube is lightly clamped in place and can be retrieved from the tube-aligning device by a light pulling force, resulting in the straightened condition of the tube being fixed. In this form, the tube-aligning device is relatively small and can be installed as a stand-alone component assembly in a do-it-yourself cigarette maker as previously described so that even very deformed tubes can be prepared for the do-it-yourself cigarette maker. The tube-aligning device is very simple and speedy to operate.

With the do-it-yourself cigarette maker and the component assemblies advantageously configured in accordance with the invention, a large number of high-quality cigarettes can be produced in a relatively short period of time with very little manual effort. In addition, due to the plucking roller being removable and since, after removing the tappet, a through hole materializes through the tobacco chamber, the do-it-yourself cigarette maker in accordance with the invention is easy to clean and to service.

In the foregoing description, preferred embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. cigarette maker including a tobacco rod shaping mechanism, comprising;

a funnel-shaped tobacco material infeed section, wherein a side-wall section of said infeed section is pivot-mounted:

a singling device for said tobacco material; and, a tobacco rod compression mechanism;

said singling device being a roller, partly surrounded by a housing, with a plucking mechanism arranged at a circumference of said roller, said tobacco material being conveyed into said tobacco rod compression mechanism.

2. The cigarette maker including tobacco rod shaping mechanism as set forth in claim 1, wherein said funnel-shaped infeed surface comprises at least one wall section oriented radially to an axis of said roller.

3. The cigarette maker including tobacco rod shaping mechanism as set forth in claim 1, wherein said tobacco rod compression mechanism comprises a tobacco chamber which can be opened and closed by at least one traveling side, said traveling side of said chamber being shifted by a cam from an opened position into a closed position, in overcoming a spring preload, and an opening width of the chamber is settable by means of a positioner.

4. The cigarette maker including tobacco rod shaping mechanism as set forth in claim 1, wherein a sidewall of said tobacco rod compression mechanism is provided with an ati-stick coating.

5. The cigarette maker including tobacco rod shaping mechanism as set forth in claim 1, wherein said roller is insetably removable.

6. The cigarette maker including tobacco rod shaping mechanism as set forth in claim 1, wherein said plucking mechanism is made of a material resistant to corrosion.

7. The cigarette maker including tobacco rod shaping mechanism as set forth in claim 6, said material resistant to corrosion being an $AlO_2$ surface finish.

8. The cigarette maker including tobacco rod shaping mechanism as set forth in claim 1, said plucking mechanism being a plucking roller with plucking pins.

9. The cigarette maker including tobacco rod shaping mechanism as set forth in claim 1, further comprising a tube conveyor for supplying tubes to the automated cigarette maker including a tube hopper for receiving a supply of empty cigarette tubes, a discharge device for a tube for filling with a tobacco material, a holder mechanism within said tube conveyor, and a cigarette hopper for receiving filled cigarettes, said discharge device being a lifting device for raising a tube from below out of said tube hopper, wherein, said lifting device comprises a pusher, a top edge of said pusher having a longitudinal recess.

10. The cigarette maker as set forth in claim 9, wherein said pusher in said tube hopper is arranged so that said longitudinal recess, in a lowered condition, forms part of the bottom at a substantially lowest point of said tube hopper.

11. The cigarette maker as set forth in claim 9, wherein said pusher is arranged at a straight wall of said tube hopper, along which said pusher is raised, at least one deflectors being arranged at an upper part of said wall for returning all raised tubes back into said tube hopper except for a tube located in said recess of said pusher.

12. The cigarette maker as set forth in claim 11, wherein said deflector comprise at least one pivot clip oriented transversely to said longitudinal recess of said pusher and initially coming to rest on said raised tube upon raising of said pusher, and, upon a further raising said at least one pivot clip slides past said tube into slots in said pusher so that said at least one clip is located underneath said tube and transport said filled cigarette into said cigarette hopper upon lowering of said pusher.

13. The cigarette maker as set forth in claim 12, wherein said at least one clip is arranged on a common pivoting axis and is pre-tensioned by a lever weight in a direction of rotation.

14. The cigarette maker as set forth in claim 1, wherein said tube rod compression mechanism further comprises a holder mechanism having a recessed forming member at least partially surrounding a cigarette tube from above.

15. The cigarette maker including tobacco rod shaping mechanism as set forth in claim 14, wherein a longitudinal recess of a pusher, in a raised condition, together with said recessed forming member of said holder mechanism, substantially surrounds said tube during a filling procedure.

16. The cigarette maker as set forth in claim 14, wherein said holder mechanism further comprises sensors for detecting a condition of said holder mechanism.

17. The cigarette maker including tobacco rod shaping mechanism as set forth in claim 16, said sensors being a photocell.

18. The cigarette maker including tobacco rod shaping mechanism as set forth in claim 1, further comprising a tube hopper for supplying tubes to the cigarette maker is configured as a drawer.

19. The cigarette maker including tobacco rod shaping mechanism as set forth in claim 18, wherein said drawer is a removable catchment vessel for the tobacco material.

20. The cigarette maker set forth in claim 1, wherein said rod shaping mechanism further comprising a tappet, for shuttling in and out of a chamber containing a tobacco plug, wherein said tappet comprises an outer tube, in which a guide rod runs said guide rod comprising at a front end an insertion aid for a tobacco rod.

21. The cigarette maker including tobacco rod shaping mechanism as set forth in claim 20, wherein said guide rod comprises at a rear appendage, a spring within said outer tube, said insertion aid for said tobacco material thereby entering said outer tube.

22. The cigarette maker including tobacco rod shaping mechanism as set forth in claim 20, said insertion aid having a length substantially equal to said tobacco rod and being shaped to assist pushing of said tobacco rod in a conveying direction.

23. The cigarette maker including tobacco rod shaping mechanism as set forth in claim 22, wherein said insertion aid is configured as a toothed blade.

24. The cigarette maker including tobacco rod shaping mechanism as set forth in claim 22, wherein said insertion aid is configured as a spiral guide.

25. The cigarette maker including tobacco rod shaping mechanism as set forth in claim 20 wherein said tappet is shifted back and forth at its rear end by means of an eccentric drive and a retaining lever holding said outer tube in position upon removal of said guide rod after conveyance of said tobacco rod.

26. The cigarette maker including tobacco rod shaping mechanism as set forth in claim 20, wherein said tappet in a tobacco rod conveyor, a tobacco compression chamber in said tobacco rod shaping mechanism, and a tube holding mechanism are all arranged in sequence and configured so that upon removal of said tappet, a through hole exists in said sequence.

27. The automated cigarette maker including a tobacco rod shaping mechanism of claim 1 comprising;

said housing having said singling device for said tobacco material rotatably positioned therein;

said funnel-shaped infeed defining an opening in said housing;

a tobacco chamber disposed beneath said singling device;

a preloaded compressive pusher slidably positioned within said housing.

28. The cigarette maker including tobacco rod shaping mechanism of claim 27, said compressive pusher being preloaded by a spring.

29. The cigarette maker of claim 27, said tobacco rod shaping mechanism having an outer tube and a toothed blade axially aligned with said tobacco chamber.

30. The cigarette maker of claim 27, further comprising a tube conveyor for supplying tubes to the cigarette maker.

31. The cigarette maker of claim 27, said tube conveyor axially aligning cigarette tubes with said tobacco chamber and toothed blade.

32. The cigarette maker including a tobacco rod shaping mechanism of claim 1, comprising;

said singling device having a plurality of plucking pins mounted on an outer circumference;

an upper portion of said housing defining a hopper above said singling device;

a preloaded compressive pusher and housing forming a said tobacco chamber beneath said device; and, a cam operatively engaging said preloaded compressive pusher between a first position and second position.

33. A cigarette maker including a tobacco rod shaping mechanism, comprising:

a tobacco material hopper wherein a side-wall of said tobacco material hopper is pivot-mounted;

said tobacco material hopper disposed above a singling device, said singling device being a roller partly surrounded by a housing with a plucking mechanism arranged at a circumference of said roller;

said singling device conveying tobacco material into a tobacco rod compression mechanism;

said plucking mechanism being a plurality of plucking pins mounted about said circumference of said roller;

a preloaded compressive pusher and said housing forming a tobacco chamber beneath said singling device; and a cam operatively engaging said preloaded compressive pusher between a first position and a second position.

* * * * *